US007743538B2

(12) United States Patent
Parenti et al.

(10) Patent No.: US 7,743,538 B2
(45) Date of Patent: Jun. 29, 2010

(54) EXTRUDED PLASTIC U-CHANNEL SIGN POST COVERS

(75) Inventors: Chris Parenti, Novi, MI (US); Loren Venegas, Canton, MI (US)

(73) Assignee: Ideal Shield, LLC, Detroit, MI (US)

( * ) Notice: Subject to any disclaimer, the term of this patent is extended or adjusted under 35 U.S.C. 154(b) by 107 days.

(21) Appl. No.: 12/014,393

(22) Filed: Jan. 15, 2008

(65) Prior Publication Data

US 2009/0178318 A1 Jul. 16, 2009

(51) Int. Cl.
*G09F 15/00* (2006.01)

(52) U.S. Cl. ..... 40/607.01; 40/613; 52/844

(58) Field of Classification Search ..... 40/607.01, 40/612, 316; 116/63 R; 52/843, 844, 846
See application file for complete search history.

(56) References Cited

U.S. PATENT DOCUMENTS

| | | | | | |
|---|---|---|---|---|---|
| 2,193,994 | A * | 3/1940 | Weaver | 52/264 |
| 3,928,930 | A * | 12/1975 | Attwood | 40/606.12 |
| 4,641,443 | A * | 2/1987 | Wilmes | 40/316 |
| 5,970,678 | A * | 10/1999 | Pellock et al. | 52/843 |
| 6,158,379 | A | 12/2000 | Burlando | |
| 6,233,898 | B1 | 5/2001 | Burlando | |
| 6,237,263 | B1 * | 5/2001 | Hagstrom et al. | 40/316 |
| 6,826,885 | B2 * | 12/2004 | Raskin et al. | 52/844 |
| 6,901,879 | B2 | 6/2005 | Burlando | |
| 7,146,920 | B1 * | 12/2006 | Ryan et al. | 114/85 |
| 2002/0124448 | A1 * | 9/2002 | Seville | 40/607 |
| 2006/0174526 | A1 * | 8/2006 | Kekeis et al. | 40/612 |
| 2008/0016816 | A1 * | 1/2008 | Kim | 52/633 |

OTHER PUBLICATIONS

Eberl Iron Works Inc., product list printout from website.
Comade, printout of product from website.
Nucor Steel Marion, Inc., Rib-Bak product printout from website.

* cited by examiner

*Primary Examiner*—Gary C Hoge
(74) *Attorney, Agent, or Firm*—Gifford, Krass, Sprinkle, Anderson & Citkowski, P.C.

(57) ABSTRACT

Covers for U-channel or C-channel sign posts comprise an extruded hollow plastic form having a length, the form in cross-section including a generally flat front wall and opposing generally flat side walls. Each side wall converges toward the other at an angle from the front wall to a back section having a width less than the front wall, thereby forming a generally trapezoidal interior. Each side wall is bent toward the other to form overlapping portions that make up the back section. In the preferred embodiments, the front wall further includes a co-extruded reflective, fluorescent, phosphorescent or colored lengthwise strip of material to enhance visibility, and the back section further includes an engagement mechanism between the overlapping portions including one or more sets of engaging barbs. The back section may further include a rearward wall extending from one of the overlapping portions and folded over the overlapping portions forming a rearward wall to assist in maintaining the engagement of the barbs.

3 Claims, 3 Drawing Sheets

Fig - 1
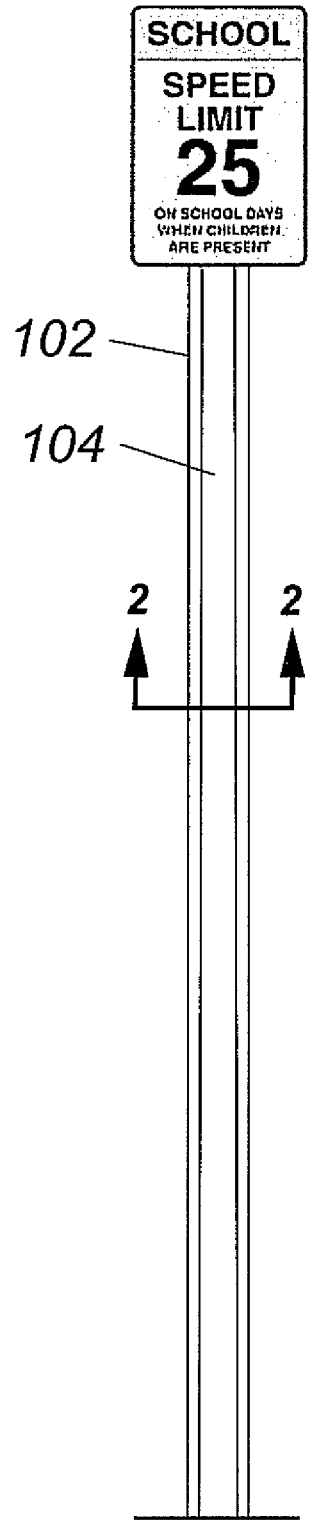
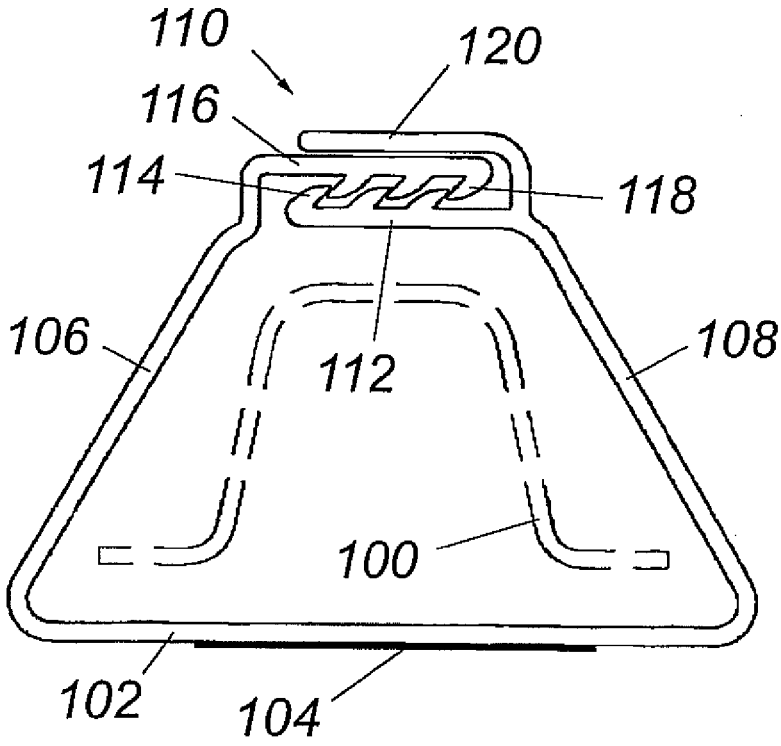
Fig - 2

EXTRUDED PLASTIC U-CHANNEL SIGN POST COVERS

FIELD OF THE INVENTION

This invention relates generally to post covers and, in particular, to extruded plastic covers for U-channel sign posts.

BACKGROUND OF THE INVENTION

There are four primary types of steel shapes used for traffic sign support posts: U-channel, square tube, tubular (pipe) and I-beam. U-channel posts have opposing outstanding flanges and come in several sizes. The back portion of a U-channel post may be smooth or may include lengthwise supporting ribs. A plurality of apertures are provided through the back portion and a traffic sign is mounted with threaded fasteners passing through the sign which is juxtaposed against the front flanges. Available sizes and designs may be found at http://www.nsmarion.com/ribbak_b.html, incorporated herein by reference.

Attempts have been made to at least partially cover U-channel sign posts, including cover with reflective materials. U.S. Pat. No. 6,233,898 discloses a reflective member mountable to a traffic sign post, the member having face portion with a rear face portion abutting the outwardly extending flanges of the post and a front face portion to augment the warning capability of the sign post or to provide a text message. This first member has a U-shaped channel that mates about the exterior of the U-shaped channel of the traffic sign post to which it is mounted by means of threaded fasteners. A reflective warning or textual message may be provided on two sides or all sides of the sign post using a second mounting member secured to the first member 10 by means of threaded fasteners passing through the longitudinal edges of second mounting member and through the rear face portion of the first member.

U.S. Pat. Nos. 6,158,379 and 6,901,879 describe a reflective and/or fluorescent member mountable to a traffic sign post to augment the warning capability of the traffic sign mounted on the traffic sign post. The member in a first embodiment is mounted in the recessed C-channel of the traffic sign post and is partially shielded from the sun during the day and thereby extends the life of the traffic sign which fades from the action of UV sunlight. In a second embodiment, the reflective is mounted on the face of a mounting member, the mounting member having a cross section such that it mates with the U-shaped channel of the traffic sign post, the edges of the mounting member being flanged outwardly and the reflective and/or fluorescent member may also include information of a safety, directional or commercial nature.

While the above described articles may enhance the visibility of traffic sign posts, they use multiple components and may be expensive and problematic to install. Accordingly, the need remains for an easy-to-install, inexpensive yet effective sign post cover.

SUMMARY OF THE INVENTION

This invention resides in covers for U-channel or C-channel sign posts as they are called in the trade. Such posts are defined by a rear wall and side walls which emanate from rear wall, diverge from each other defining a trapezoidal space, and terminate with opposing flanges in the same plane generally parallel to the rear wall.

Covers according to the invention comprise an extruded hollow plastic form having a length, the form in cross-section including a generally flat front wall and opposing generally flat side walls. Each side wall converges toward the other at an angle from the front wall to a back section having a width less than the front wall, thereby forming a generally trapezoidal interior. Each side wall is bent toward the other to form overlapping portions that make up the back section.

In the preferred embodiments, the front wall further includes a co-extruded reflective, fluorescent, phosphorescent or colored lengthwise strip of material to enhance visibility, and the back section further includes an engagement mechanism between the overlapping portions including one or more sets of engaging barbs. The back section may further include a rearward wall extending from one of the overlapping portions and folded over the overlapping portions forming a rearward wall to assist in maintaining the engagement of the barbs.

BRIEF DESCRIPTION OF THE DRAWINGS

FIG. 1 is a front view of a traffic sign with a sleeve according to the invention covering the post thereof;

FIG. 2 is a cross section of the post and cover of FIG. 1;

DETAILED DESCRIPTION OF THE INVENTION

Figure 3:
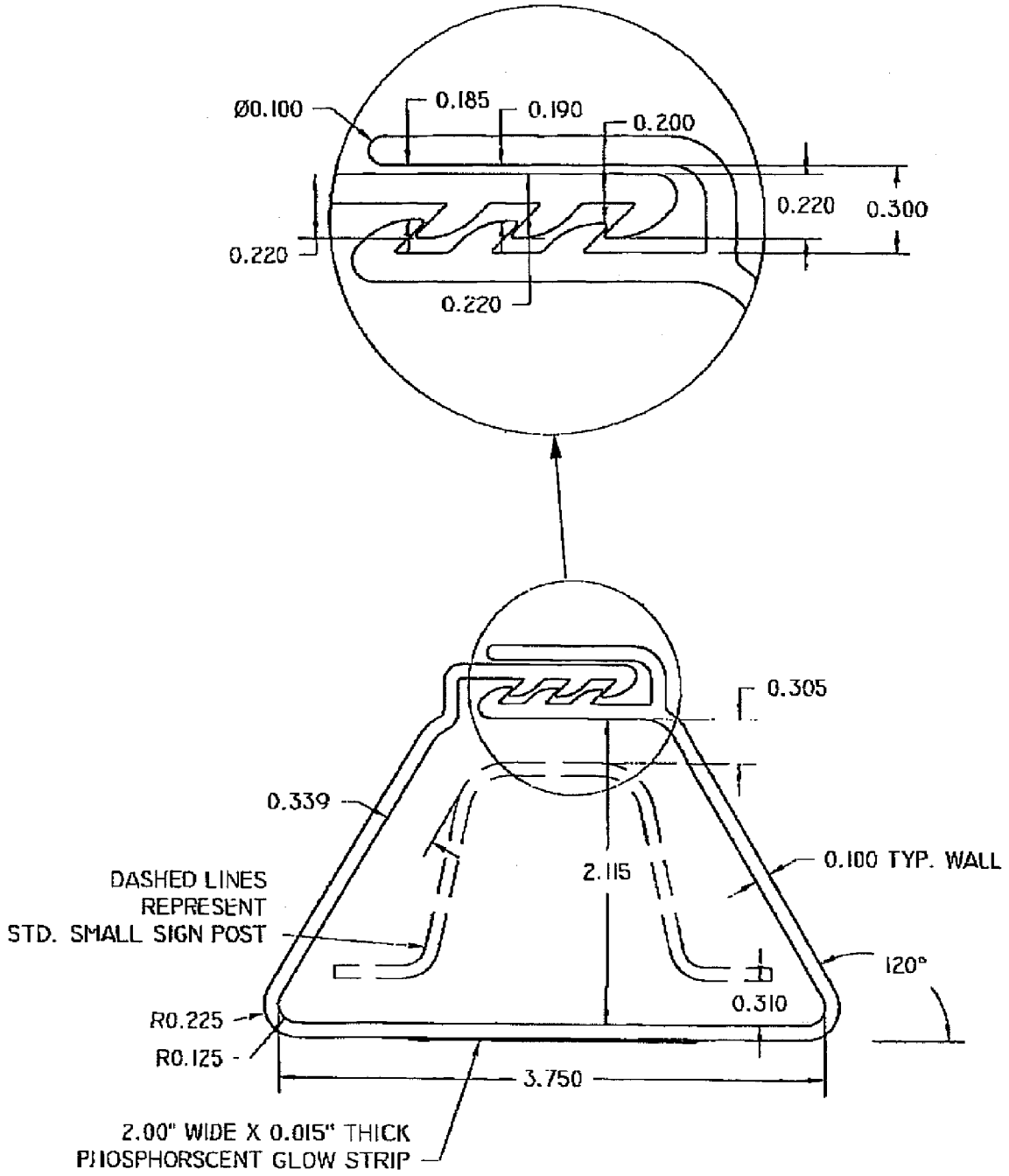
FIG. 3 is a cross section of the post and cover of FIG. 1 showing a set of dimensions.
Figure 4:
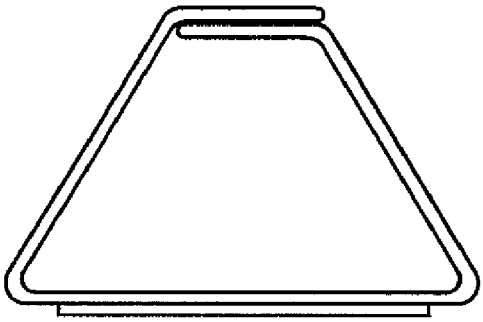
FIG. 4 is a cross section of an alternative cover construction.
Figure 5:
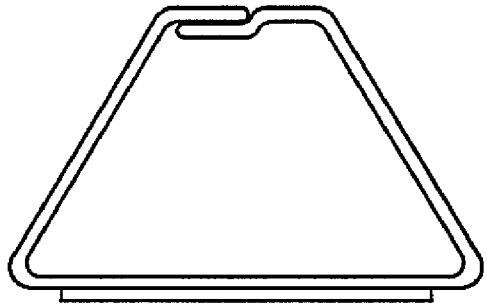
FIG. 5 is a cross section of an alternative cover construction.
Figure 6:
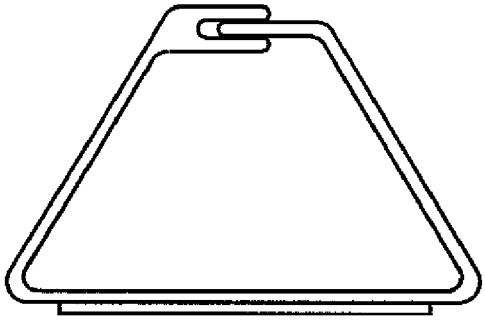
FIG. 6 is a cross section of an alternative cover construction.
Figure 7:
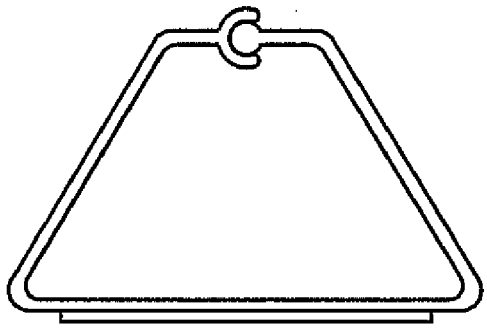
FIG. 7 is a cross section of an alternative cover construction.
Figure 8:
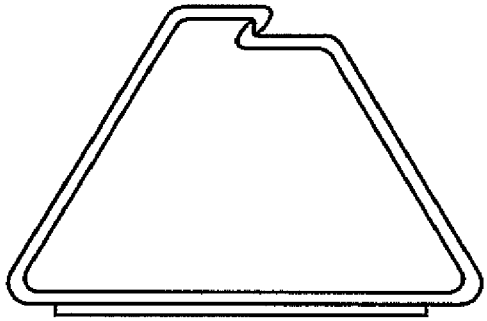
FIG. 8 is a cross section of an alternative cover construction.

This invention is directed to extruded plastic covers for sign posts, commonly referred to in the trade as a U-channel or C-channel posts. Referring first to FIG. 2, sign post 10 is defined by a rear wall 12 and side walls 14, 16 which emanate from rear wall 12 and diverge from each other defining a trapezoidal space 18. Side walls 14, 16 terminate with opposing flanges 20, 22 which are in the same plane and define the front face of traffic sign post 10 which is generally parallel to rear wall 12. Rear wall 12 is formed with a plurality of spaced apart apertures (not shown) along its entire vertical face.

FIG. 1 illustrates the preferred embodiment of a sign post cover 102 including a strip of material 104 to enhance visibility. The length of the cover 102 may be any appropriate length to suit typically signage, and may therefore be in the range of 3-12 feet. FIG. 2 is a cross section of the post cover 102 installed over U-channel post 10. The cover 102, fabricated through plastic extrusion, includes a generally flat front wall 103 to which the strip 104 is attached. In the preferred embodiment, strip 104 is co-extruded into front wall 103, though adhesives or other attachment mechanisms may alternatively be used following extrusion of the form. Strip 104 may be reflective, fluorescent, phosphorescent, or of a bright color. Indeed, strip 104 may be eliminated altogether if the purpose of the invention is only to cover and protect the sign post without enhancing visibility.

Figure 9:
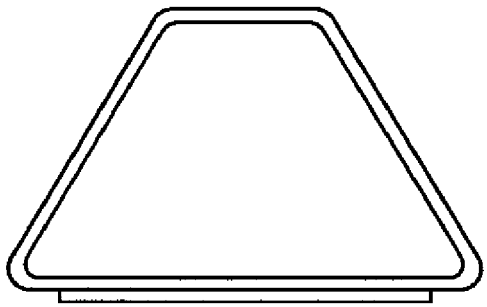
FIG. 9 is a cross section of an alternative cover construction.
Figure 10A:
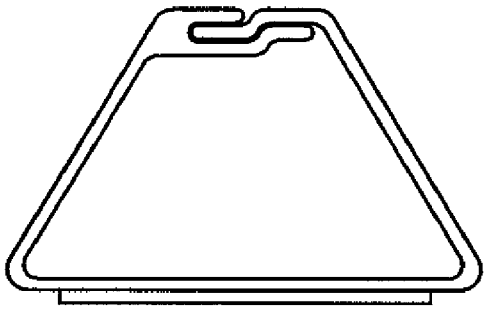
FIG. 10A is a cross section of an alternative cover construction.
Figure 10B:
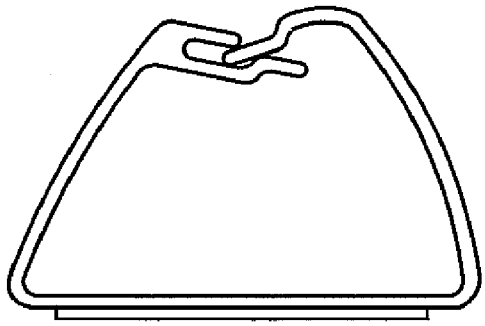
FIG. 10B is a cross section of the alternative cover construction of FIG. 10A illustrating how the cover is fastened over a post.

Front wall 103 transitions on either side to side wall 106, 108 which converge at angles toward one another to a back section 110 having a width less than that of the front wall 103, thereby forming a cross section which is generally trapezoidal in shape. With the exception of the embodiment shown in FIG. 9, all embodiments of the invention include overlapping portions in the back section 110. In the preferred embodiments, the back section 110 further include barbs or some other type of engagement mechanism. In FIGS. 2 and 3, this engagement mechanism includes multiple 114 on a forward back wall 112 which engage with multiple barbs 118 on an intermediate back wall 116. A rearward back wall 120 serves to cover the other back walls and keep the barbs engaged to defeat vandalism.

FIG. 3 is a drawing of the structure of FIG. 2 with a set of dimensions. Front wall 103 preferably has a width of 3-4 inches and the interior depth of the cover is in the range of 1.5-3 inches, thereby providing an article capable of covering U-channel sign posts of different sizes. Covers according to the invention may be made from polyethylene any suitable extruded polymeric material. Wall thickness is in the range of 0.05-0.25 inches. Strip 104 is preferably on the order of 1-3 inches in width, though in alternative embodiments the entire extruded form may be fabricated from a reflective, fluorescent, phosphorescent, or brightly colored material.

FIGS. 4-10 are cross sections of alternative embodiments of the invention. The embodiment of FIG. 10A uses a lengthwise seam joint similar to that found on round galvanized sheet metal furnace ducts, thereby requiring the manipulation shown in FIG. 10B to facilitate engagement. The embodiment of FIG. 9 would be installed before a sign is fastened to the post.

We claim:

1. A cover for a U-channel or C-channel sign post defined by a rear wall and side walls which emanate from rear wall, diverge from each other defining a trapezoidal space, and terminate with opposing flanges in the same plane generally parallel to the rear wall, the cover comprising:

an extruded hollow plastic form having a length;

the form in cross-section including a generally flat front wall and opposing generally flat side walls;

each side wall converging toward the other at an angle from the front wall to a back section having a width less than the front wall, thereby forming a generally trapezoidal interior; and wherein:

each side wall is bent toward the other to form overlapping portions that make up the back section; and the front wall further includes a reflective, fluorescent, phosphorescent or colored lengthwise strip of material to enhance visibility.

2. A cover for a U-channel or C-channel sign post defined by a rear wall and side walls which emanate from rear wall, diverge from each other defining a trapezoidal space, and terminate with opposing flanges in the same plane generally parallel to the rear wall, the cover comprising:

an extruded hollow plastic form having a length;

the form in cross-section including a generally flat front wall and opposing generally flat side walls;

each side wall converging toward the other at an angle from the front wall to a back section having a width less than the front wall, thereby forming a generally trapezoidal interior; and wherein:

each side wall is bent toward the other to form overlapping portions that make up the back section; and the front wall further includes an integrally molded reflective, fluorescent, phosphorescent or colored lengthwise strip of material to enhance visibility.

3. A cover for a U-channel or C-channel sign post defined by a rear wall and side walls which emanate from rear wall, diverge from each other defining a trapezoidal space, and terminate with opposing flanges in the same plane generally parallel to the rear wall, the cover comprising:

an extruded hollow plastic form having a length;

the form in cross-section including a generally flat front wall and opposing generally flat side walls;

each side wall converging toward the other at an angle from the front wall to a back section having a width less than the front wall, thereby forming a generally trapezoidal interior; and wherein:

each side wall is bent toward the other to form overlapping portions that make up the back section;

the overlapping portions include one or more sets of engaging barbs; and further including a rearward wall extending from one of the overlapping portions and folded over the overlapping portions forming a rearward wall to assist in maintaining the engagement of the barbs.

* * * * *